US011911655B2

(12) United States Patent
Nikmanesh

(10) Patent No.: US 11,911,655 B2
(45) Date of Patent: Feb. 27, 2024

(54) ABDOMINAL EXERCISE EQUIPMENT

(71) Applicant: Afrouz Nikmanesh, Irvine, CA (US)

(72) Inventor: Afrouz Nikmanesh, Calabasas, CA (US)

( * ) Notice: Subject to any disclaimer, the term of this patent is extended or adjusted under 35 U.S.C. 154(b) by 127 days.

(21) Appl. No.: 17/845,415

(22) Filed: Jun. 21, 2022

(65) Prior Publication Data

US 2023/0405399 A1 Dec. 21, 2023

(51) Int. Cl.
*A63B 23/02* (2006.01)
*A63B 21/00* (2006.01)

(52) U.S. Cl.
CPC ..... *A63B 23/0211* (2013.01); *A63B 21/4029* (2015.10); *A63B 21/4035* (2015.10); *A63B 2225/09* (2013.01)

(58) Field of Classification Search
CPC ..... A63B 23/0211; A63B 21/4029; A63B 21/4035; A63B 2225/09; A63B 69/20–34; A63B 23/02–0227
See application file for complete search history.

(56) References Cited

U.S. PATENT DOCUMENTS

| | | | | |
|---|---|---|---|---|
| 7,534,200 | B1 * | 5/2009 | Martinez | A63B 23/02 482/142 |
| 9,669,278 | B1 * | 6/2017 | Brown | A63B 21/068 |
| 2013/0059699 | A1 * | 3/2013 | Brenner | A63B 69/224 482/83 |
| 2017/0087434 | A1 * | 3/2017 | Coles | G16H 20/30 |
| 2019/0060695 | A1 * | 2/2019 | Weisz | A63B 21/0557 |
| 2020/0155892 | A1 * | 5/2020 | Grossman | A63B 21/4034 |

FOREIGN PATENT DOCUMENTS

| | | | | |
|---|---|---|---|---|
| AU | 2021200751 | A1 * | 8/2022 | |
| GB | 2592096 | A * | 8/2021 | A63B 21/00 |

* cited by examiner

*Primary Examiner* — Nyca T Nguyen
(74) *Attorney, Agent, or Firm* — Michael M. Ahmadshahi

(57) ABSTRACT

An abdominal exercise equipment comprises a rest pad, a foot grip, a frame, and three contact arms. The rest pad is disposed in a horizontal direction and the foot grip slides up and down perpendicular to the rest pad. A frame moves at an oblique angle to the rest pad and three contact arms are slidably coupled with the frame and provide targets for a user to contact using his/her hands.

20 Claims, 4 Drawing Sheets

ABDOMINAL EXERCISE EQUIPMENT

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

The present invention relates to an abdominal exercise equipment and method of use. The equipment comprises a rest pad, a foot grip and three contact arms which can independently move in four directions. A user of the equipment initially rests on the rest pad and alternatively lifts his/her body to contact the contact arms, thereby, engaging his/her abdominal muscles.

BACKGROUND

A conventional abdominal exercise equipment lacks components which direct the user to move his/her body in a targeted and efficient manner. In particular, the conventional equipment does not include components which can move in four different directions, thereby, allowing the user to secure his/her body to the equipment and subsequently lift to contact three independent contact arms. Therefore, there is a need for an abdominal exercise equipment which provides three independent targets for the user to contact via his/her arms to more effectively exercise his/her abdominal muscles.

SUMMARY

In one aspect, an abdominal exercise equipment is disclosed wherein the equipment comprises a rest pad slidably coupled with a first rail along a first direction, a foot grip slidably coupled with a second rail along a second direction, wherein said second rail is fixedly coupled with the rest pad, a frame slidably coupled with a third rail along a third direction, a first contact arm slidably coupled with the frame along the third direction, a second contact arm slidably coupled with the frame along a fourth direction, and a third contact arm slidably coupled with the frame along the fourth direction.

Preferably, the second direction is perpendicular to the first direction.

Preferably, the third direction is at an oblique angle to the first direction.

Preferably, the oblique angle is 60 degrees.

Preferably, the fourth direction is perpendicular to the first direction.

Preferably, the rest pad comprises a cushioned rectangular rest plate.

Preferably, the foot grip comprises two cushioned cylindrical bars.

Preferably, the first contact arm comprises a first cushioned target plate.

Preferably, the second contact arm comprises a second cushioned target plate.

Preferably, the third contact arm comprises a third cushioned target plate.

In another aspect, a method of engaging abdominal muscles utilizing an abdominal exercise equipment is disclosed wherein the equipment comprises a rest pad slidably coupled with a first rail along a first direction, a foot grip slidably coupled with a second rail along a second direction, wherein said second rail is fixedly coupled with the rest pad, a frame slidably coupled with a third rail along a third direction, a first contact arm slidably coupled with the frame along the third direction, a second contact arm slidably coupled with the frame along a fourth direction, and a third contact arm slidably coupled with the frame along the fourth direction, wherein the method, comprises resting on the rest pad, securing both feet to the foot grip, lifting to contact the first contact arm with both hands, resting on the rest pad, lifting and turning to contact the second contact arm with a first hand, resting on the rest pad, and lifting and turning to contact the third contact arm with a second hand.

Preferably, the second direction is perpendicular to the first direction.

Preferably, the third direction is at an oblique angle to the first direction.

Preferably, the oblique angle is 60 degrees.

Preferably, the fourth direction is perpendicular to the first direction.

Preferably, the rest pad comprises a cushioned rectangular rest plate.

Preferably, the foot grip comprises two cushioned cylindrical bars.

Preferably, the first contact arm comprises a first cushioned target plate.

Preferably, the second contact arm comprises a second cushioned target plate.

Preferably, the third contact arm comprises a third cushioned target plate.

DETAILED DESCRIPTION OF THE PRESENTLY PREFERRED EMBODIMENTS

Figure 1:
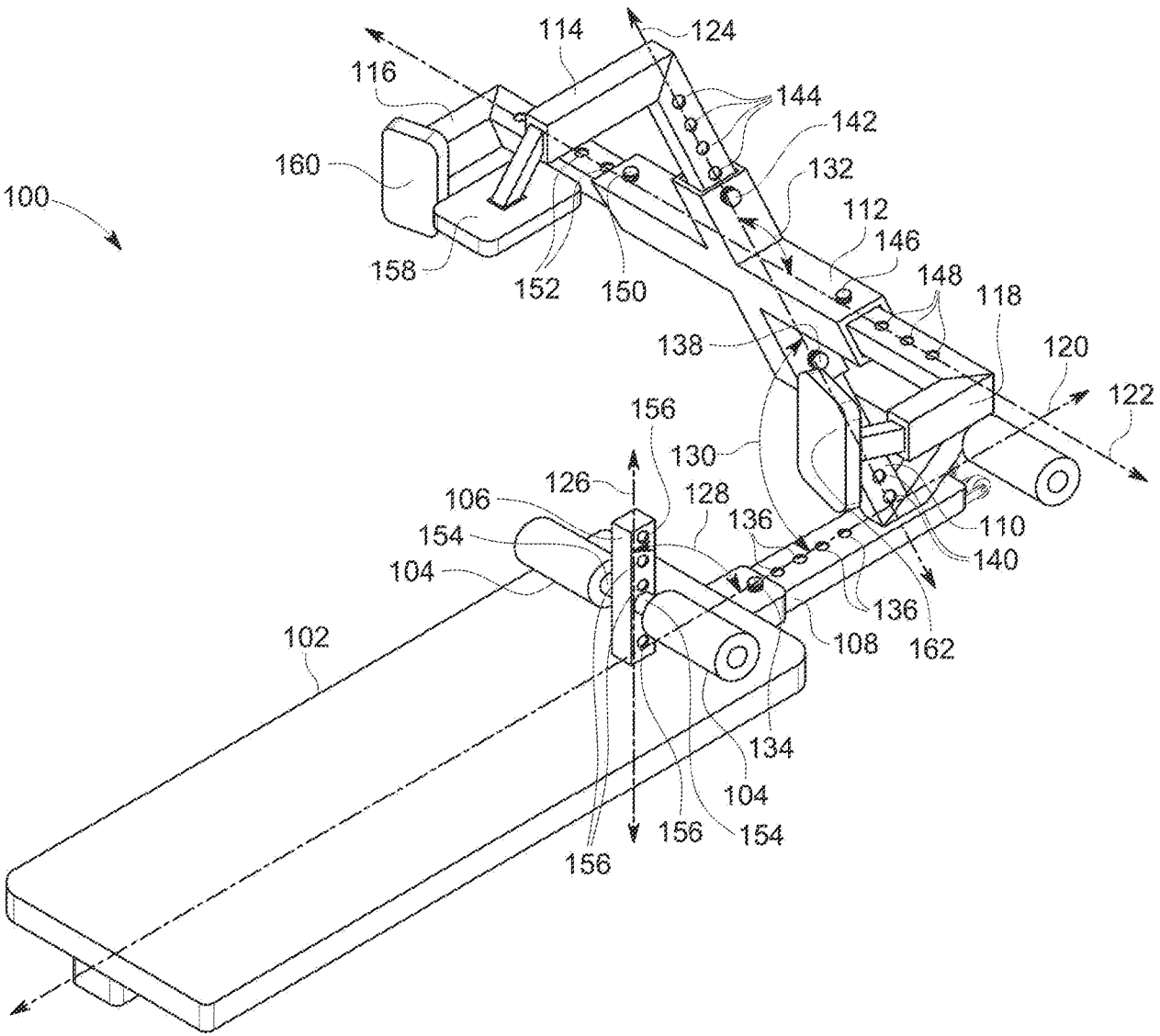
FIG. 1 shows a perspective view of an abdominal exercise equipment according to a preferred embodiment. The equipment includes a rest pad, a foot grip, a frame, a first contact arm, a second contact arm, and a third contact arm.

FIG. 1 depicts a perspective view of an abdominal exercise equipment 100 according to a preferred embodiment. The equipment 100 includes a rest pad 102 which is slidably coupled with a first rail 108. The rest pad 102 can move along a first direction 120. In particular, the rest pad 102 can slide along the first direction 120 and can be fixed in position at different locations along the first direction 120 utilizing a pin 134 and a plurality of holes 136.

A foot grip 104 is also slidably coupled with a second rail 106 along a second direction 126. In particular, the foot grip 104 can slide up and down along the second directions 126 and can be fixed in position at different heights along the second direction 126 utilizing pins 154 and a plurality of holes 156. The second rail 106 is fixedly coupled with the rest pad 102. An angle 128 between the first direction 122 and the second direction 126 is 90 degrees.

A frame 112 is slidably coupled with a third rail 110 along a third direction 124. In particular, the frame 112 can slide along the third direction 124 and can be fixed in position at different locations along the third direction 124 utilizing a pin 138 and a plurality of holes 140. An oblique angle 130 between the third direction 124 and the first direction 120 is 60 degrees.

A first contact arm 114 is slidably coupled with the frame 112 along the third direction 124. In particular, the first contact arm can slide along the third direction 124 and can be fixed in position at different locations along the third direction 124 utilizing a pin 142 and a plurality of holes 144.

A second contact arm 116 is slidably coupled with the frame 112 along a fourth direction 122. In particular, the second contact arm can slide along the fourth direction 122 and can be fixed in position at different locations along the fourth direction 122 utilizing a pin 150 and a plurality of holes 152.

A third contact arm 118 is slidably coupled with the frame 112 along the fourth direction 122. In particular, the third contact arm can slide along the fourth direction 122 and can be fixed in position at different locations along the fourth direction 122 utilizing a pin 146 and a plurality of holes 148.

According to a preferred embodiment, the rest pad 102 can be made from a rectangular rest plate, preferably made from wood, hard plastic, aluminum, or steel. A cushioning material can be utilized to cover the rectangular rest plate so as to provide comfortable resting on the rest pad 102. Similarly, the foot grip 104 can be made from a cylindrical bar, preferably made from wood, hard plastic, aluminum, or steel. A cushioning material can be utilized to cover the foot grip 104 to provide comfortable contact with the foot grip 104.

According to a preferred embodiment, the first contact arm may include a first cushioned target plate 158, the second contact arm may include a second cushioned target plate 160, and the third contact arm may include a third cushioned target plate 162.

Figure 2:
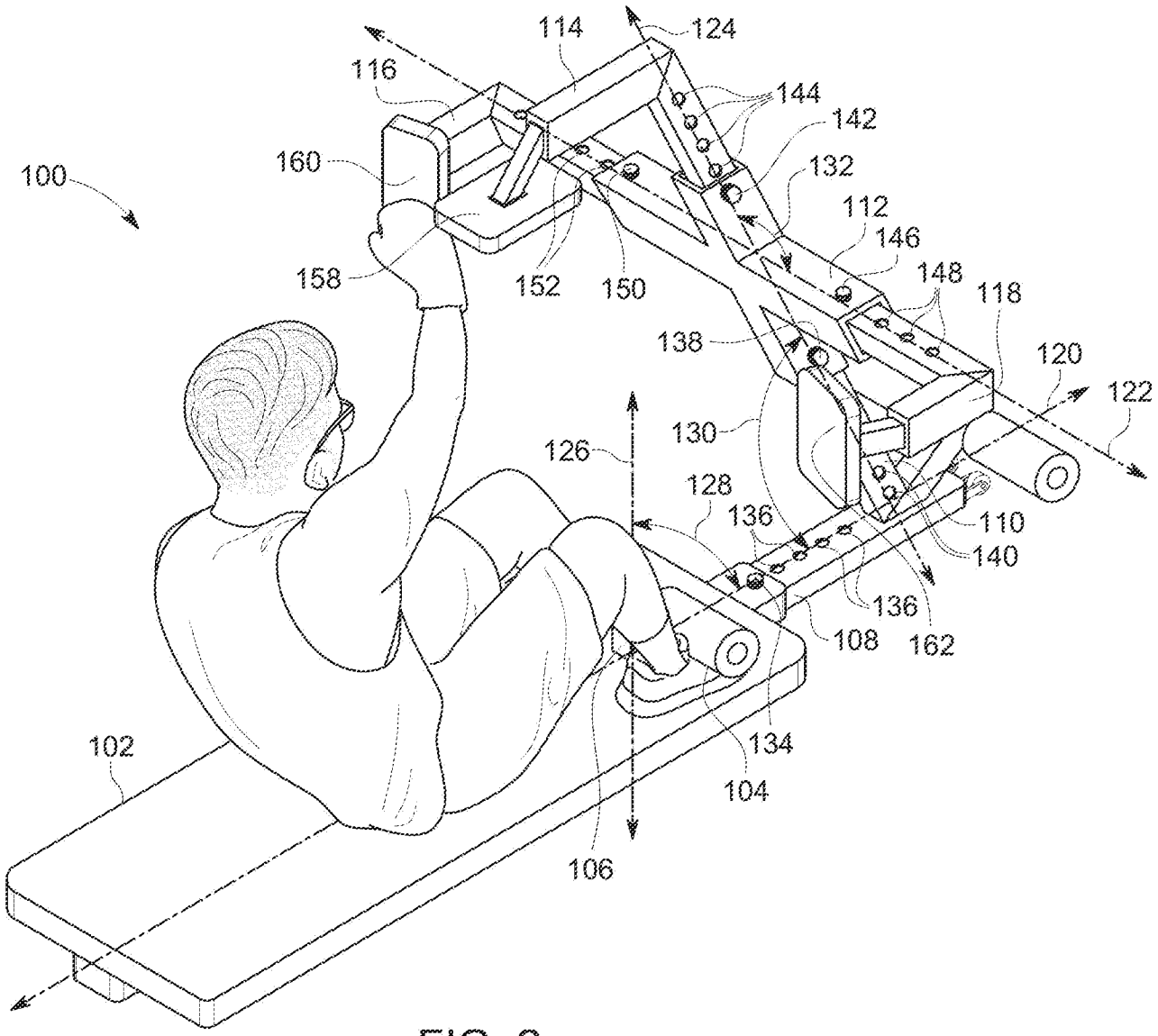
FIG. 2 shows a user lifting and turning to contact the second contact arm of the abdominal exercise equipment shown in FIG. 1 by his right arm.
Figure 3:
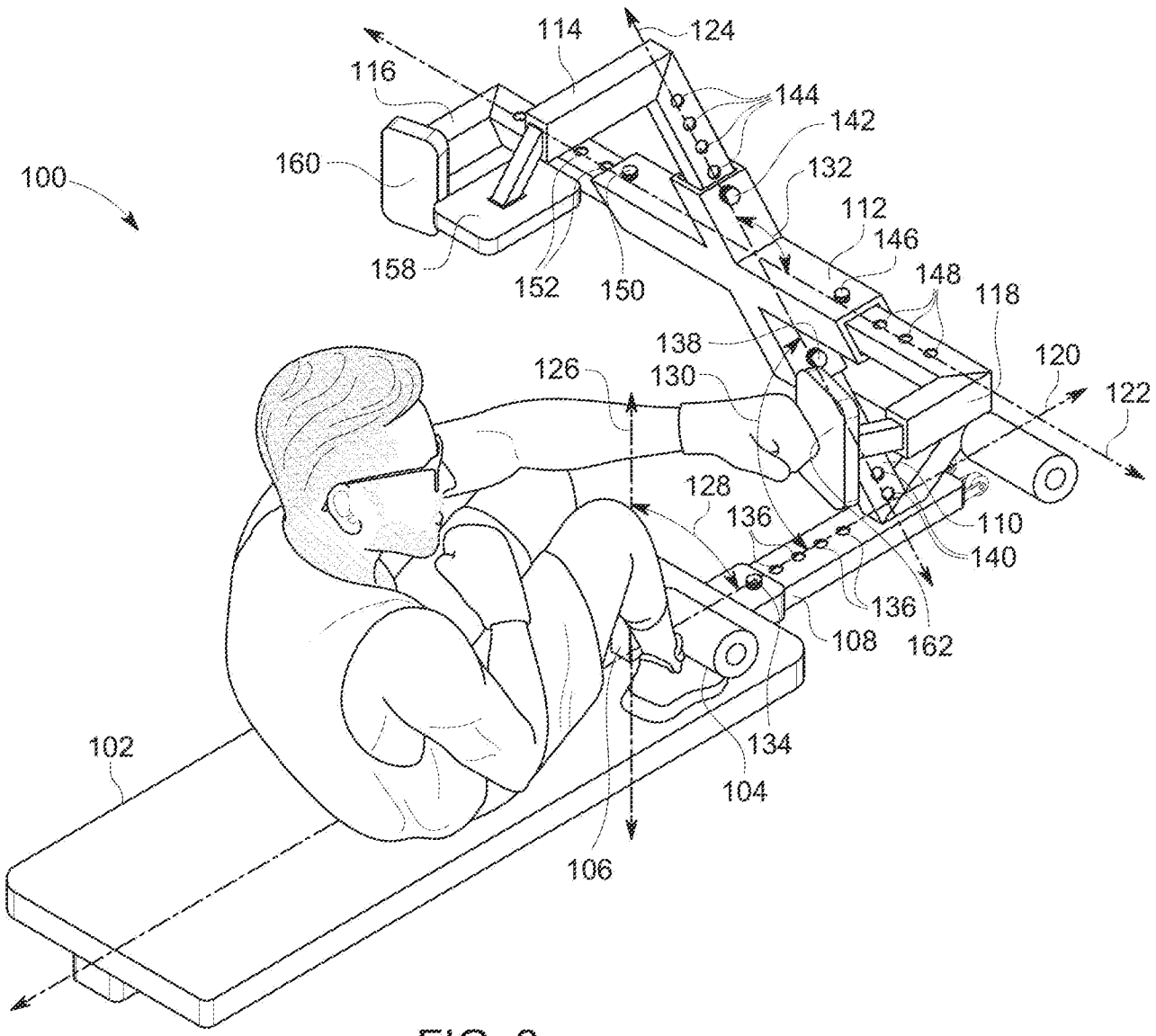
FIG. 3 shows a user lifting and turning to contact the third contact arm of the abdominal exercise equipment shown in FIG. 1 by his left arm.
Figure 4:
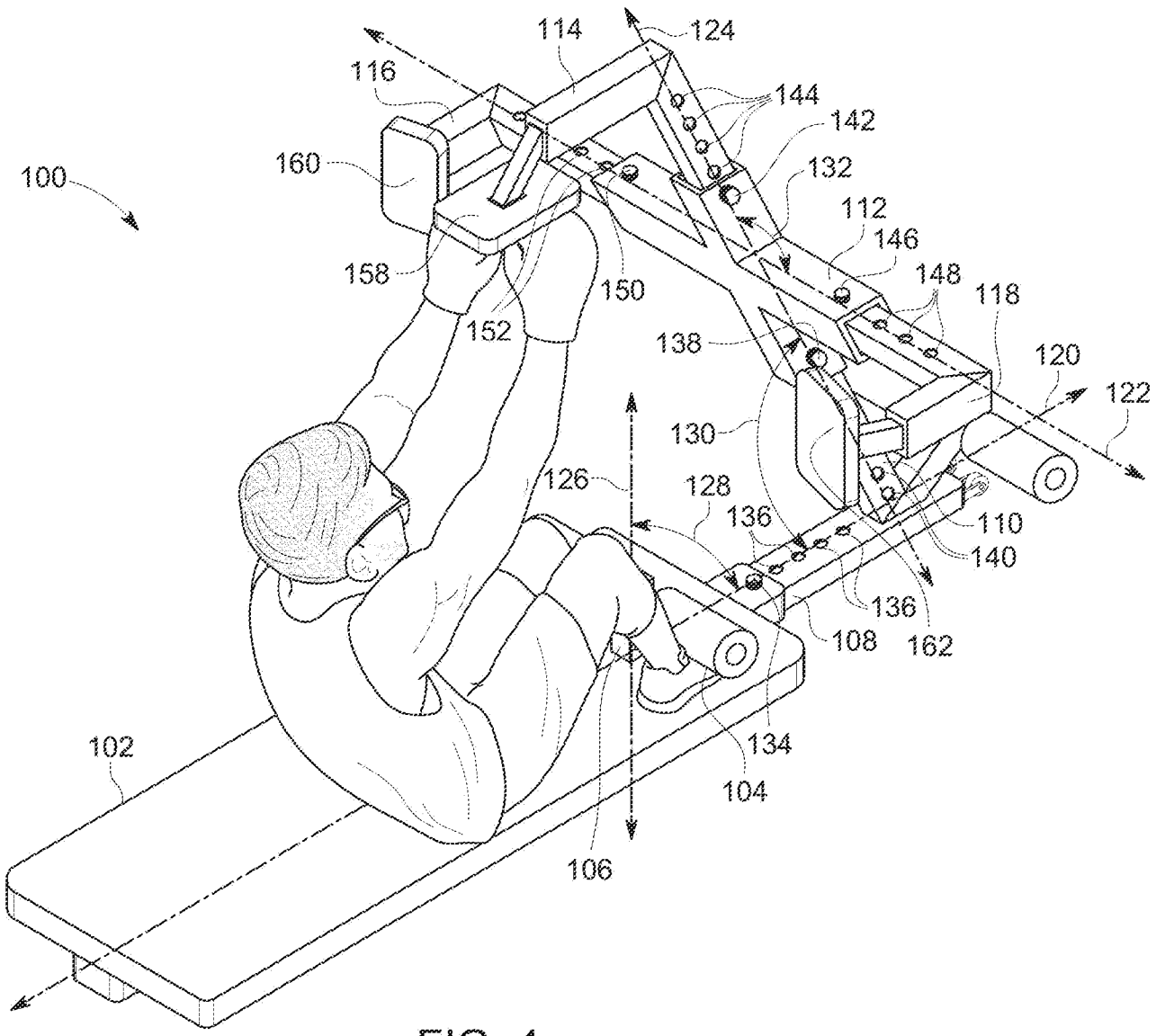
FIG. 4 shows a user lifting to contact the first contact arm of the abdominal exercise equipment shown in FIG. 1 by both his arms.

Utilizing the above abdominal exercise equipment 100 shown in FIGS. 2 through 4, one method of engaging abdominal muscles will be described. A user performs a step of resting on the rest pad 102. The user further performs a step of securing both his/her feet to the foot grip 104. The user further performs the step of lifting himself/herself to contact the first contact arm 114 and in particular the first cushioned target plate 158 with both his/her hands, see FIG. 2. The user further performs the step of lifting and turning himself/herself to contact the second contact arm 116 and in particular the second cushioned target plate 160 with his/her right hand, see FIG. 3. The user further performs the step of lifting and turning himself/herself to contact the third contact arm 118 and in particular the third cushioned target plate 162 with his/her left hand, see FIG. 4.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. An abdominal exercise equipment, comprising:

(a) a rest pad slidably coupled with a first rail along a first direction;

(b) a foot grip slidably coupled with a second rail along a second direction, wherein said second rail is fixedly coupled with the rest pad;

(c) a frame slidably coupled with a third rail along a third direction;

(d) a first contact arm slidably coupled with the frame along the third direction;

(e) a second contact arm slidably coupled with the frame along a fourth direction; and (f) a third contact arm slidably coupled with the frame along the fourth direction.

2. The equipment of claim 1, wherein the second direction is perpendicular to the first direction.

3. The equipment of claim 1, wherein the third direction is at an oblique angle to the first direction.

4. The equipment of claim 3, wherein the oblique angle is 60 degrees.

5. The equipment of claim 1, wherein the fourth direction is perpendicular to the first direction.

6. The equipment of claim 1, wherein the rest pad comprises a cushioned rectangular rest plate.

7. The equipment of claim 1, wherein the foot grip comprises two cushioned cylindrical bars.

8. The equipment of claim 1, wherein the first contact arm comprises a first cushioned target plate.

9. The equipment of claim 1, wherein the second contact arm comprises a second cushioned target plate.

10. The equipment of claim 1, wherein the third contact arm comprises a third cushioned target plate.

11. A method of engaging abdominal muscles utilizing an abdominal exercise equipment, said equipment comprising:

(a) a rest pad slidably coupled with a first rail along a first direction;

(b) a foot grip slidably coupled with a second rail along a second direction, wherein said second rail is fixedly coupled with the rest pad;

(c) a frame slidably coupled with a third rail along a third direction;

(d) a first contact arm slidably coupled with the frame along the third direction;

(e) a second contact arm slidably coupled with the frame along a fourth direction; and (f) a third contact arm slidably coupled with the frame along the fourth direction;

said method, comprising:

(i) resting on the rest pad;

(ii) securing both feet to the foot grip;

(iii) lifting to contact the first contact arm with both hands;

(iv) resting on the rest pad;

(v) lifting and turning to contact the second contact arm with a first hand;

(vi) resting on the rest pad; and (vii) lifting and turning to contact the third contact arm with a second hand.

12. The equipment of claim 11, wherein the second direction is perpendicular to the first direction.

13. The equipment of claim 11, wherein the third direction is at an oblique angle to the first direction.

14. The equipment of claim 13, wherein the oblique angle is 60 degrees.

15. The equipment of claim 1, wherein the fourth direction is perpendicular to the first direction.

16. The equipment of claim 11, wherein the rest pad comprises a cushioned rectangular rest plate.

17. The equipment of claim 11, wherein the foot grip comprises two cushioned cylindrical bars.

18. The equipment of claim 11, wherein the first contact arm comprises a first cushioned target plate.

19. The equipment of claim 11, wherein the second contact arm comprises a second cushioned target plate.

20. The equipment of claim 11, wherein the third contact arm comprises a third cushioned target plate.

* * * * *